US007029347B2

(12) United States Patent
Atsusawa

(10) Patent No.: US 7,029,347 B2
(45) Date of Patent: Apr. 18, 2006

(54) WATER PRECLUSION DEVICE FOR MARINE ENGINE

(75) Inventor: Hidenori Atsusawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/270,927

(22) Filed: Oct. 11, 2002

(65) Prior Publication Data

US 2003/0077957 A1 Apr. 24, 2003

(30) Foreign Application Priority Data

Oct. 18, 2001 (JP) ..... 2001-320078

(51) Int. Cl.
*B63H 21/34* (2006.01)

(52) U.S. Cl. ..... 440/89 E; 440/89 R; 60/324

(58) Field of Classification Search ..... 440/89 R, 440/89 E, 89 F; 181/226; 60/324
See application file for complete search history.

(56) References Cited

U.S. PATENT DOCUMENTS 2,072,372 A * 3/1937 Kingsley ..... 181/264
3,548,778 A * 12/1970 Von Smagala-Romanoff .... 440/85
3,751,921 A * 8/1973 Blomberg et al. ..... 60/324
4,498,876 A * 2/1985 Zemlicka ..... 440/89 R
4,665,692 A * 5/1987 Inaba ..... 60/324
4,773,883 A 9/1988 Nakase et al.
4,787,869 A 11/1988 Shiozawa
4,811,560 A 3/1989 Nakase et al.
4,957,461 A 9/1990 Nakayama
4,997,399 A 3/1991 Nakayasu et al.
5,234,364 A 8/1993 Ito
5,241,853 A * 9/1993 Tsuei et al. ..... 73/116
5,324,217 A 6/1994 Mineo
5,366,401 A 11/1994 Nanami et al.
5,531,620 A 7/1996 Ozawa et al.
5,554,057 A 9/1996 Abe et al.
5,586,922 A 12/1996 Kobayashi et al.
5,791,953 A * 8/1998 Gunderson et al. ..... 440/89 R
5,967,862 A * 10/1999 Motose ..... 440/1
6,106,344 A 8/2000 Mashiko
6,109,027 A * 8/2000 Schaefer ..... 60/324
6,158,215 A * 12/2000 Bosch et al. ..... 60/312
6,179,096 B1 * 1/2001 Kinerson et al. ..... 188/154
6,220,907 B1 * 4/2001 Shimizu ..... 440/89 R
6,261,140 B1 7/2001 Yoshida et al.
6,299,496 B1 * 10/2001 Griffiths et al. ..... 440/89 R
6,322,409 B1 * 11/2001 Hattori et al. ..... 440/88 R

* cited by examiner

*Primary Examiner*—Andrew D. Wright
(74) *Attorney, Agent, or Firm*—Knobbe, Martens, Olson & Bear, LLP

(57) ABSTRACT

A water preclusion device for a watercraft with an internal combustion engine for inhibiting the intrusion of water upstream into an exhaust system. The water preclusion device includes a valve controlled by exhaust gas pressure.

19 Claims, 7 Drawing Sheets

WATER PRECLUSION DEVICE FOR MARINE ENGINE

PRIORITY INFORMATION

This application is based on and claims priority to Japanese Patent Application No. 2001-320078, filed Oct. 18, 2001 the entire contents of which is hereby expressly incorporated by reference.

BACKGROUND OF THE INVENTION

1. Field of the Invention

The present invention relates generally to a water preclusion device for an engine, and more particularly to an improved water preclusion device using a valve controlled by in-cylinder pressure.

2. Brief Description of Related Art

Various watercraft engines with partially submerged exhaust systems which open to a body of water, typically incorporate a water preclusion device. When such an engine is running, the exhaust gases are discharged into the body of water through the exhaust pipe under a positive pressure. This positive pressure prohibits water from flowing into the engine. However, as soon as the engine stops, water can enter the exhaust pipe and cause damage.

Many modern watercraft include elevated inverted-U shaped high-riser exhaust pipes placed above the water line to prevent the invasion of water when the engine stops. Incorporating a high rise pipe in the exhaust system requires ample space and results in a high profile and a higher center of gravity.

Designing the engine compartment of low profile, compact, internal combustion engine-powered watercraft requires special consideration. Such low profile watercraft provide improved handling due to a low center of gravity and overall compact design. However, such watercraft do not accommodate high-rise type exhaust systems.

Thus, certain low-profile watercraft designs have incorporated spring-biased valves opened by exhaust pressure and which close as exhaust pressure drops. Relatively weak springs are used to reduce or eliminate back pressure in the exhaust system. However, such relatively weak springs are limited in that they do not provide sufficient pressure to completely seal the valve and thus allow water to enter under certain conditions.

SUMMARY OF THE INVENTION

One aspect of the present invention includes the realization that in-cylinder pressure of the engine of a watercraft can be used to operate a valve disposed in-line in the exhaust system, without relying on the positive pressure in main exhaust passage to open the valve. Thus, the exhaust system is not burdened with the additional back pressure for opening the valve, and the valve can include a stronger spring to bias it to a closed position.

In accordance with another aspect of the present invention, a watercraft comprises a hull and an engine supported by the hull. The engine includes an engine body defining at least one combustion chamber. An exhaust system comprises an exhaust gas passage extending from the engine body to a valve, the valve being configured to be controlled by pressure in a cylinder port passage. The cylinder port passage is configured to communicate cylinder pressure from the engine body to the valve. The valve is mounted at least partially in the exhaust gas passage and is configured to be movable between a first position in which the exhaust gas passage is open and a second position in which the exhaust gas passage is closed.

In accordance with a further aspect of the present invention, a watercraft comprises a hull and an engine supported by the hull. The engine includes an engine body defining at least one combustion chamber. An exhaust system comprises an exhaust conduit extending from the engine body to the atmosphere. The watercraft also includes a valve movable between a first position in which the exhaust conduit is closed and a second position in which the exhaust conduit is open. Additionally, the watercraft includes means for controlling movement of the valve which does not rely solely on pressure in the exhaust conduit for moving the valve.

In accordance with yet another aspect of the present invention, a method is provided for preventing water from flowing upstream in an exhaust system for a watercraft having an engine including an engine body defining at least one combustion chamber and a first exhaust conduit extending from the engine body to the atmosphere. The method comprises guiding pressure from the combustion chamber to a valve controller through a second conduit, and moving a valve to an open position with pressure in the second conduit. A watercraft comprising a hull defining the engine compartment, an engine positioned within the engine compartment, the engine comprising at least one cylinder including at least one cylinder port, an exhaust system including at least one exhaust valve configured to prevent the invasion of water into the engine, the cylinder port being communication with the exhaust valve, a pressure conduit communicating with the cylinder port for operating the exhaust valve while the engine is running In accordance with an additional aspect of the present invention, a watercraft comprises a hull defining the engine compartment. An engine is positioned within the engine compartment. The engine comprises at least one cylinder including at least one cylinder port. An exhaust system includes at least one exhaust valve configured to prevent the invasion of water into the engine, the cylinder port being in communication with the exhaust valve. A pressure conduit communicates with the cylinder port for operating the exhaust valve while the engine is running In accordance with yet another additional aspect of the present invention, a watercraft comprises a hull defining an engine compartment and an engine positioned within the engine compartment. The engine comprises at least one cylinder including at least one cylinder port. An exhaust system includes at least one exhaust valve configured to prevent the invasion of water into the engine. The cylinder port is in communication with the exhaust valve. A pressure conduit communicates with the cylinder port operating the exhaust valve while the engine is running. The pressure conduit incorporates an expansion chamber. The expansion chamber is configured to smooth pressure fluctuations in the pressure conduit.

BRIEF DESCRIPTION OF THE DRAWINGS

The foregoing features, aspects, and advantages of the present invention will now be described below with reference to the drawings of preferred embodiments that are intended to illustrate and not to limit the invention. The drawings comprise seven figures in which.

DETAILED DESCRIPTION OF THE PREFERRED EMBODIMENTS OF THE INVENTION

The Overall Construction

Figure 1:
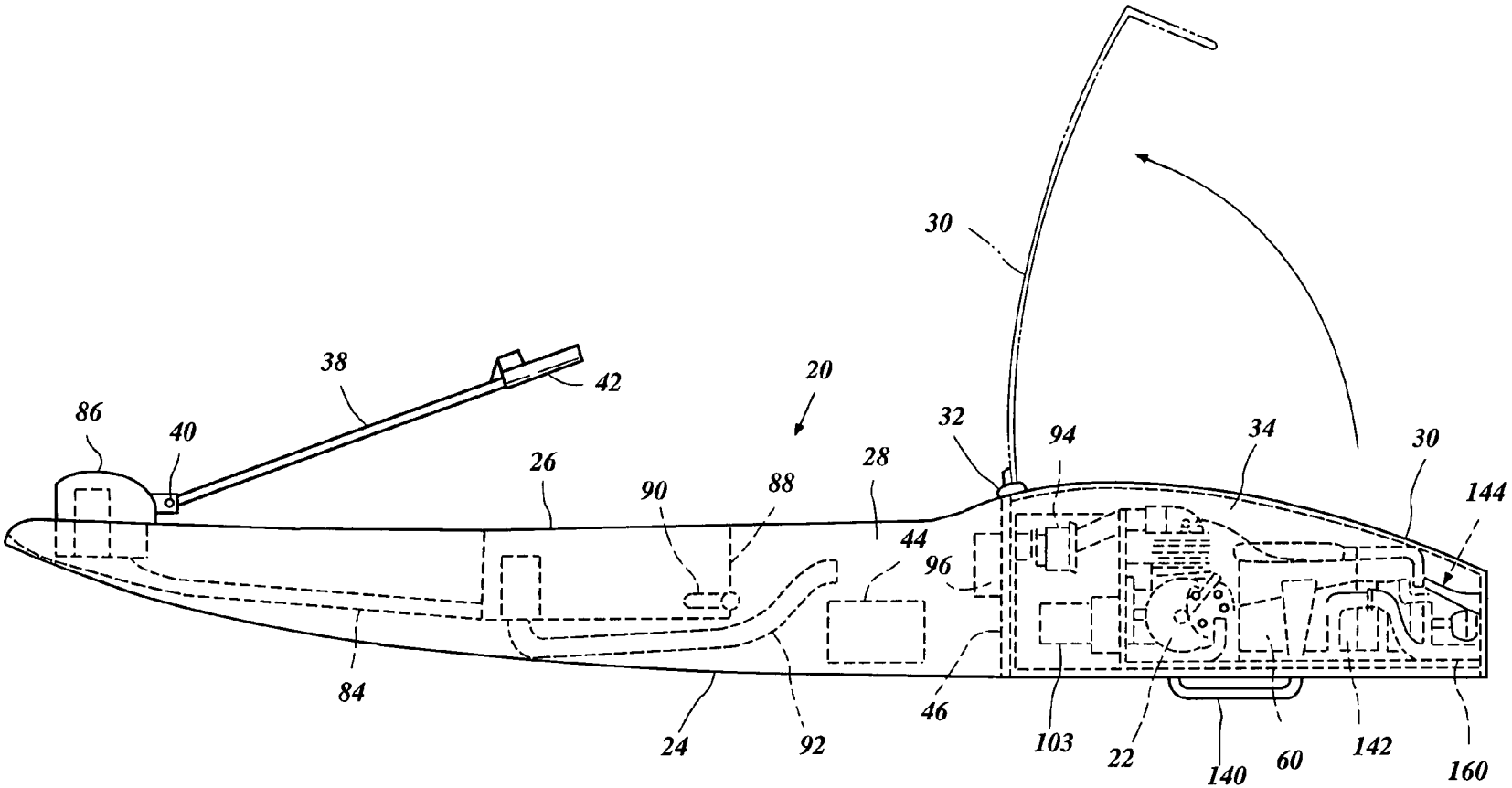
FIG. 1 is a side elevational view of a watercraft configured in accordance with a preferred embodiment of the present invention, with various associated parts such as an engine and jet pump, shown in phantom.
Figure 2:
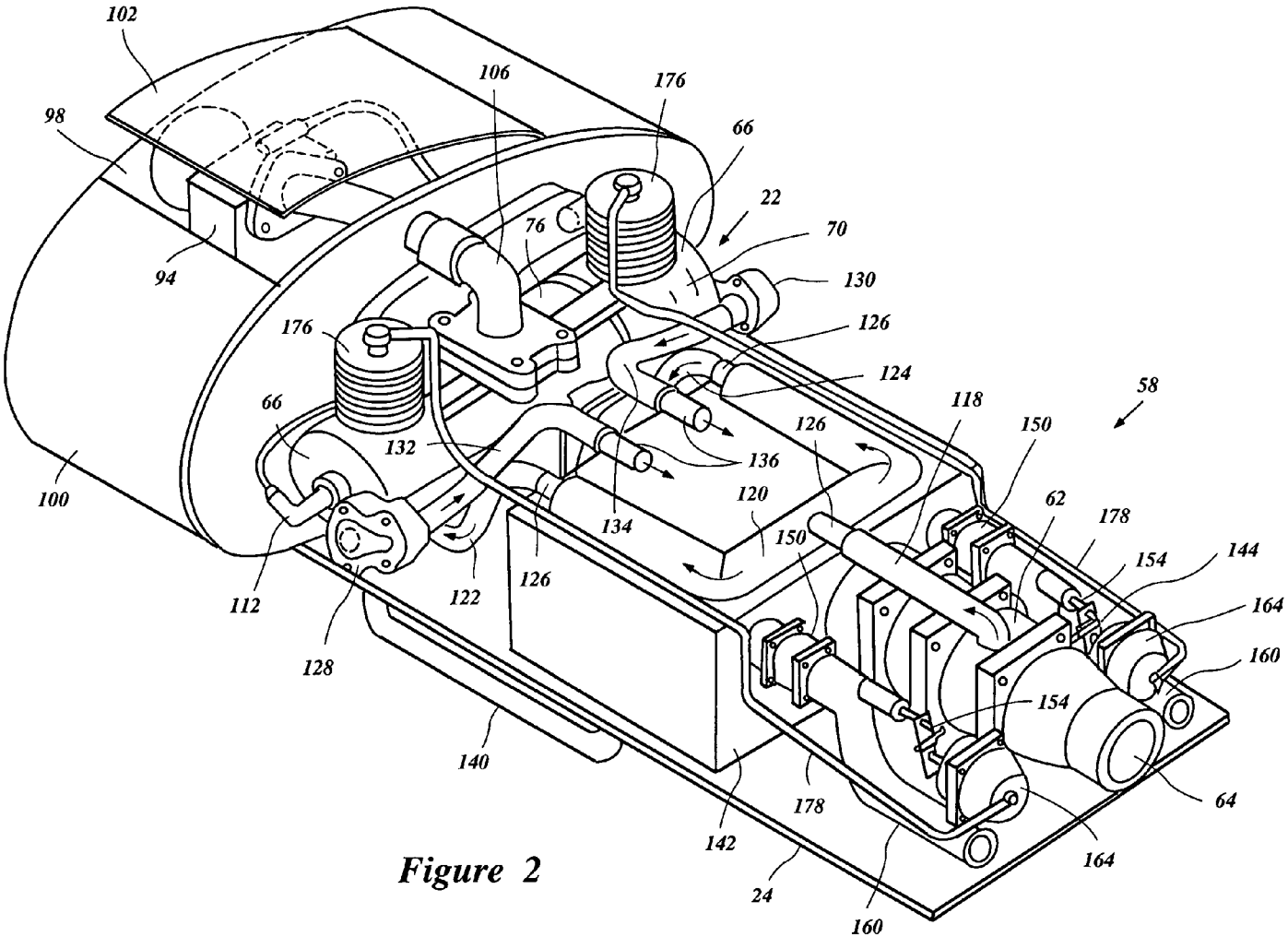
FIG. 2 is an enlarged top, rear, and left side perspective view of a portion of the watercraft with a rear portion of the hull removed.
Figure 3:
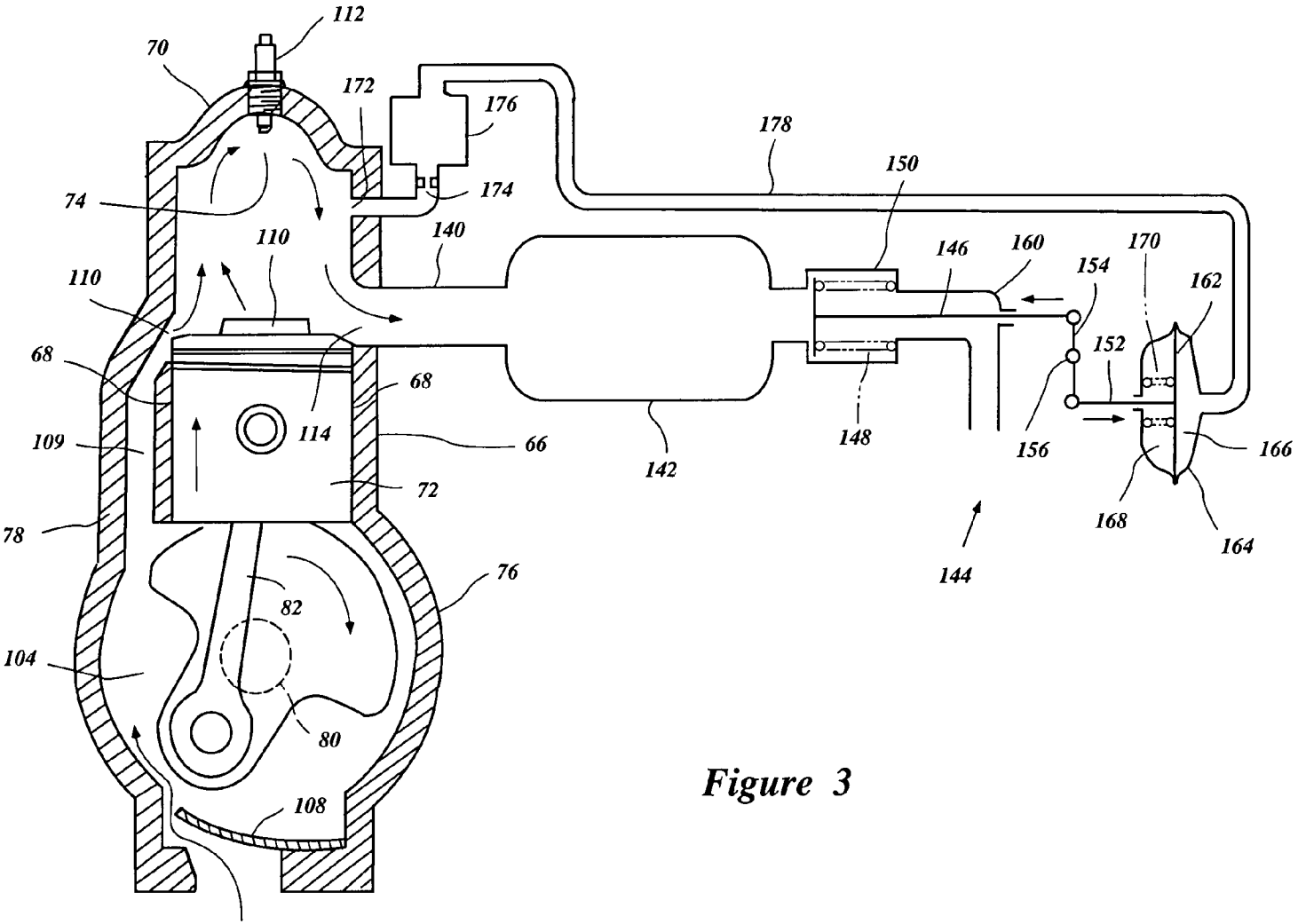
FIG. 3 is a partial sectional and schematic view of the engine and exhaust system shown in FIG. 2.

With reference to FIGS. 1 through 3, an overall configuration of a watercraft 20 and its engine 22 is described below. The watercraft 20 employs the internal combustion engine 22, which is configured in accordance with a preferred embodiment of the present invention. The described engine configuration has particular utility for use within the small watercraft, and thus, is described in the context of a personal watercraft. The engine configuration also can be applied to other types of vehicles, such as, for example, small jet boats, other water vehicles, and other land vehicles.

With reference initially to FIG. 1, the watercraft 20 includes a lower hull section 24 and an upper hull section or deck 26. The lower hull section 24 and the upper hull section 26 can be formed integrally or can be coupled together to define an internal cavity 28.

The internal cavity 28 can be divided into a plurality of separate compartments. In the illustrated embodiment, a bulkhead 29 divides the cavity 28 into a forward compartment 31 and an engine compartment 34. FIG. 1 illustrates the upper hull section 14 preferably comprising a hatch cover 30 connected by a hinge 32 in an open position, which covers an engine compartment 34. The closed position of the hatch cover 30 is also illustrated in phantom lines.

A control mast 38 extends upwardly from a support hinge 40 to support a control grip 42. The control grip 42 is provided primarily as a handle for the operator of the watercraft 20. The control grip 42 preferably carries other mechanisms, such as, for example, a throttle lever (not shown) connected to a throttle valve of the engine 22 to control the engine output (i.e., to vary the engine speed).

A fuel tank 44 is positioned in the forward portion of the cavity 28 under the upper hull section 26. A duct preferably couples the fuel tank 44 with a fuel inlet port positioned at a top surface of the upper hull section 26. A closure cap (not shown) closes the fuel inlet port to inhibit water infiltration.

The engine 22 is disposed in the engine compartment 34. In general, the engine compartment 34 can be defined behind the cavity 28 by a forward bulkhead 46. Other configurations, however, are possible.

A jet pump unit 58 propels the watercraft 20. Other types of marine drives can be used depending upon the application. The jet pump unit 58 preferably is disposed behind the engine 22 within a tunnel 60 formed by the lower hull section 24. The tunnel 60 has a downward facing inlet (not shown) opening toward the body of water. A jet pump housing 62 is disposed within a portion of the tunnel 60. Preferably, an impeller (not shown) is supported within the housing 62.

An impeller shaft (not shown) comprising one or more segments, extends forwardly from an impeller (not shown) and is coupled with a crankshaft 63 of the engine 22. The crankshaft 63 of the engine 22 thus drives the impeller shaft. The rear end of the housing 62 defines a discharge nozzle 64.

With reference to FIG. 3, the engine 22 in the illustrated arrangement operates on a two-stroke combustion principal. The engine 22 includes at least one cylinder block 66 defining at least one cylinder bore 68. A cylinder head member 70 closes the upper end of cylinder bore 68. A piston 72 is reciprocally mounted within the cylinder bore 68. The cylinder head member 70, the cylinder bore 68 and piston 72 define a combustion chamber 74. A lower cylinder block member or crankcase member 76 is attached to the lower end of a cylinder block 78 to close the lower end of the cylinder bore 68. The crankshaft 63 within the crankcase member 76 is rotatably connected to the pistons 72 through connecting rods 82.

In the illustrated embodiment, the engine 22 includes two cylinders, each are formed in a separate cylinder block 66. The cylinder blocks 66 are disposed on opposite sides of a longitudinal axis of the watercraft 20. Thus, the engine 22 is an opposed, two-cylinder, two-stroke engine. However, other cylinder configurations (e.g. V, in-line, W), other numbers of cylinders, and other principles of operation (e.g., diesel, rotary, four-stroke) are practicable.

An intake system is configured to guide air to the engine 22 for combustion in the combustion chamber 74. The intake system comprises a primary air duct 84 with a respective intake air duct opening 86. The air duct 84 communicates with an air box 88 positioned under the upper deck 26. A one-way water drain 90 is disposed in the bottom side of the air box 88. A second air duct 92 lies beneath the air box 88 and leads from the air box 88 to the internal cavity 28.

An air filter 96 is positioned inside the internal cavity 28. A carburetor 94 communicates with the air filter 96 through the bulkhead 46. The carburetor 94 is located in a watertight cavity 98 enclosed by an induction compartment 100. The carburetor 94 can be accessed through an induction compartment access cover 102. When in the closed position, the cover 102 is configured to seal the induction compartment 100 from water invasion. The induction compartment also houses a starter 103 configured to crank the engine 22 at a speed sufficient to start the engine 22.

Induction air enters the primary air duct 84 through the intake air duct opening 86 and travels through the primary duct 84 to the air box 88. The one way water drain 90 allows any water drawn into the air box 88 through the primary air duct 84 to be drained to the outside environment. The water drain 90 advantageously is configured to allow water in the air box 88 to drain therefrom, but prevents water from entering the air box 88 from the outside environment. The induction air enters the internal cavity 28 through the second air duct 92 where it enters a carburetor 94 through the air filter 96.

The carburetor 94 is configured to mix air with fuel at a predetermined ratio. As the piston 72 moves in an upward motion, a negative pressure is established inside a crankcase chamber 104. The air/fuel mixture is drawn from the carburetor 94 through an intake manifold 106 and further through a reed valve 108. As the piston 72 moves in a downward motion, a positive pressure is established in the crankcase chamber 104, which closes the reed valve 108 and forces the air/fuel mixture up intake or "scavenge" passages 109 and though intake ports 110 into the combustion chamber 74.

The fresh air/fuel mixture pushes exhaust gases from a previous combustion cycle, through the exhaust port 114 after combustion as the piston moves in the downward direction. The exhaust system of the preferred embodiment is described in greater detail below.

An ignition system comprises at least one ignition coil (not shown) and at least one spark plug 112 for controlling the ignition of the air/fuel mixture. After the piston 72 compresses the air/fuel mixture within the combustion chamber 74, the spark plug 112 ignites the air/fuel mixture at a predetermined ignition timing point. The timing of the ignition can be advantageously retarded or advanced with reference to the crankshaft to ignite the air/fuel mixture at the predetermined optimal ignition timing point.

The watercraft 20 also includes a cooling system. The cooling system includes a coolant conduit 118 connecting the jet pump housing 62 to a coolant conduit branch 120. The coolant conduit branch 120 separates into a left coolant delivery conduit 122 and a right coolant delivery conduit 124, each pertaining to a left and right side of the engine 22. Various coolant connection conduits 126 are used to connect the various coolant conduits 118, 120, 122, and 124. Left and right side thermostats 128, 130 connect left and right cylinder coolant jackets with a left and right side exiting coolant return conduits 132, 134. The left and right side coolant return conduits 132 and 134 are further connected to coolant exiting ports 136.

Preferably, water is supplied under pressure through a coolant conduit 118 (FIG. 2) from the jet pump housing 62 to cool the engine 22. The pressurized coolant water can be used to cool the exhaust as well. The coolant water travels from the coolant conduit 118 into a coolant conduit branch 120 where it enters the engine 22 from the left and right coolant delivery conduits 122, 124. When a predetermined engine coolant temperature is achieved, the left and right thermostats 128, 130 open and allow the coolant water to leave the engine 22. The coolant water exits the thermostats 128, 130 through left and right coolant return conduits 132, 134, and further exits into the open water environment through coolant exiting ports 136.

The Water Preclusion Device

Figure 4:
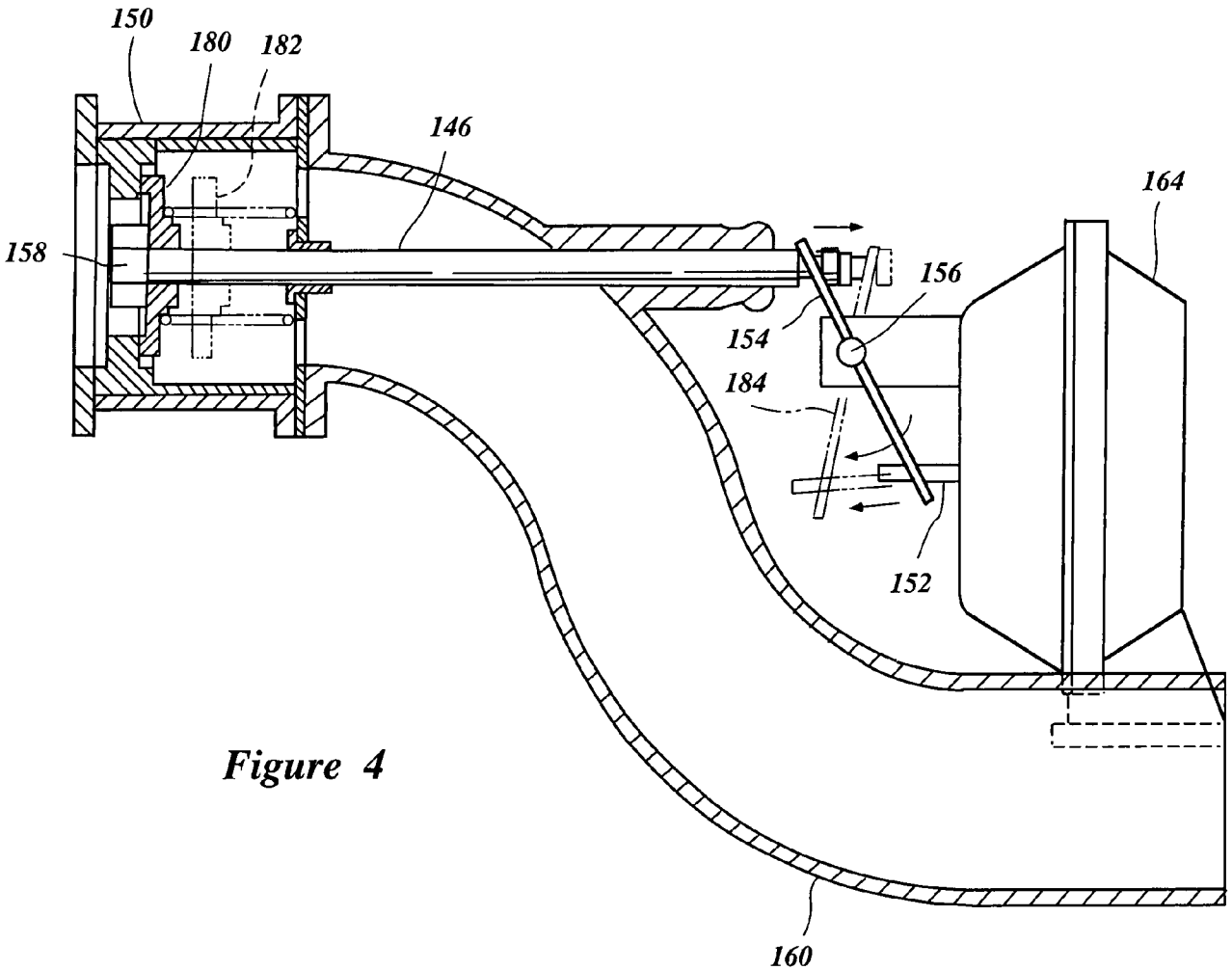
FIG. 4 is an enlarged and partial sectional view of a water preclusion device included in the exhaust system shown in FIG. 3.

With reference to FIGS. 2–4, an exhaust system delivers exhaust gases from the combustion chamber 74 of the engine 22 through the exhaust port 114 to an exhaust manifold 140 and further to an exhaust expansion chamber/muffler 142. Downstream from the exhaust expansion chamber 142, a water preclusion device 144 is disposed in the exhaust system.

With reference to FIGS. 3 through 6, the water preclusion device 144 incorporates an exhaust valve 146 biased with an exhaust valve spring 148. The exhaust valve 146 and the exhaust valve spring 148 are enclosed in an exhaust valve chamber 150. A diaphragm arm 152 connects the exhaust valve to an actuation linkage 154 that rotates about a linkage axis 156. A diaphragm 162 separates a diaphragm chamber 164 into two volumes (FIG. 3), an actuation volume 166, and an unsealed volume 168 open to the atmosphere.

As shown in FIG. 3, an actuation port 172 opens into the combustion chamber 74. The actuation port 172 is formed separately from the exhaust port 114. Preferably, the actuation port 172 is disposed closer to the cylinder head than is the exhaust port 114.

The actuation port 172 communicates with the actuation chamber 166. In the illustrated embodiment, a pressure conduit 178 connects the port 172 with the chamber 166. Thus, pressure waves from the port 172 can flow to the chamber 166 and thereby open the valve 146, without a large net flow of gasses through the port 172.

Preferably, an accumulation chamber 176 connects the port 172 with the conduit 178. The accumulation chamber 176 is configured to accumulate and thereby smooth pressure waves traveling from the combustion chamber and through the port 172. As such, the accumulation chamber 176 provides a further advantage in maintaining a more uniform pressure in the actuation chamber 166. A more uniform pressure in the actuation chamber 166 aids in maintaining the exhaust valve 146 in the desired position.

An orifice 174 preferably is disposed between the port 172 and the accumulation chamber 176. The orifice provides a further smoothing effect, and thus further enhances the uniformity of the pressure in the actuation chamber 166.

Figure 5:
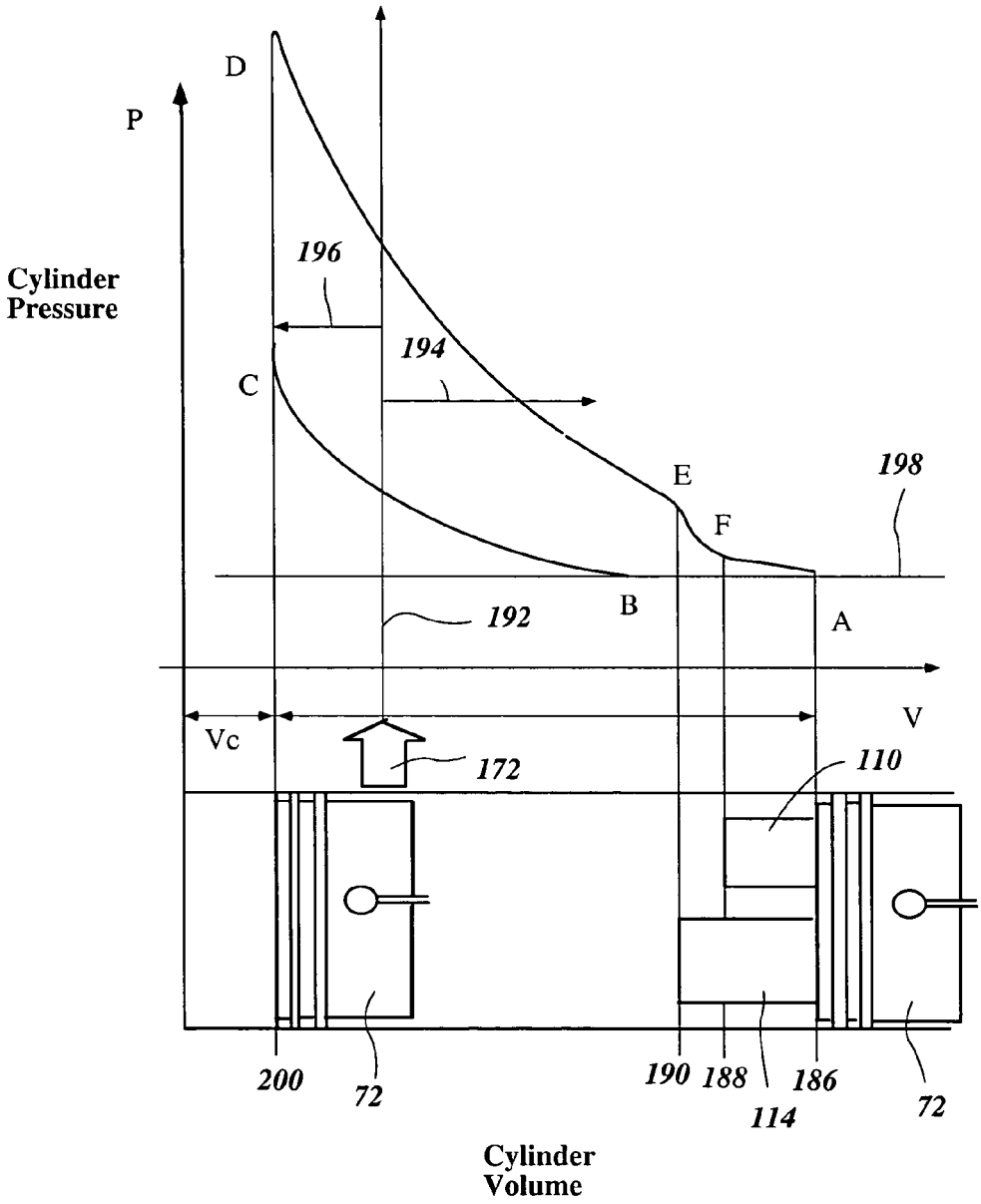
FIG. 5 is a diagram illustrating the variation of pressure and volume and piston position in the engine illustrated in FIGS. 1–3.

With reference to FIG. 5, a pressure/volume diagram combined with a piston position diagram illustrates the cylinder pressure dynamics driving the water preclusion device 144. The following description begins at the moment when the piston 72 is at bottom dead center (BDC). In a two-stroke engine, a fresh air-fuel charge is introduced into the cylinder as the piston reaches bottom dead center.

As the piston 72 moves upwardly from bottom dead center, it first closes the intake ports 110 at a point 188. As the piston 72 continues in its upward movement, the exhaust port 114 is closed at a point 190.

The pressure between two points A and B remains generally constant along a line 198, representative of atmospheric pressure. After the piston 72 closes the exhaust port 114, the in-cylinder pressure, beginning at point B, increases as the air/fuel mixture inside the cylinder is compressed. As the pressure rises above atmospheric, pressure inside the cylinder is translated through the activation port 172, represented by a line 192. This pressure translation through the activation port 172 activates the water preclusion device 144.

As the piston 72 passes the line 192 the activation port 172 is closed. An arrow 194 represents a portion of piston travel when the activation port 172 is open and an arrow 96 represents a portion of piston travel when the activation port 172 is closed. Therfore, by positioning the activation port 172 in various lateral positions with reference to piston travel, the pressure conducted to the actuation chamber 166 can be varied. The activation port 172 is placed in such a position that the piston 72 closes the activation port 172 before combustion is initiated by the spark plug 112. Therefore, more combustion energy can be transferred to the piston.

As the piston 72 approaches its highest position 200 at top dead center (TDC), the in-cylinder pressure increases from the point B to a point C. The spark plug 112 is initiated at a predetermined time and an ignition of the air/fuel mixture results in a rapid heat expansion, which quickly increases the in-cylinder pressure, from the point C to a point D. The increased cylinder pressure continues to rise until the point D where the cylinder pressure begins to forcefully move the piston 72 in a downward direction. This force is applied to the connecting rod and crankshaft where it is translated into a rotational torque.

As the piston 72 moves in the downward direction, the activation port 172 opens. Thus, the in-cylinder pressure is conducted to the chamber 166.

As the piston 72 continues in the downward direction, the cylinder pressure decreases from the point D to a point E where the exhaust port 114 is opened allowing the cylinder pressure to decrease more rapidly. This rapid pressure decrease continues for a period of time from the point E to a point F where the intake ports 110 are opened. The cylinder pressure remains almost constant due to the downward motion of the piston 72 forcing more fresh air/fuel mixture into the cylinder from the crankcase chamber 104. This pressure is maintained from the point F to the point A where the piston 72 reaches BDC (point 186) and the entire procedure repeats.

With reference to FIG. 4, the diaphragm arm 152, through the actuation linkage 154, activates the exhaust valve 146. When opened, the exhaust valve allows exhaust gases to pass through an exhaust passage 158 to the surrounding environment through exhaust pipes 160. The exhaust valve spring 148 biases the exhaust valve 146 to a closed position to prevent water from entering the engine 22 when it is not running.

When under pressure, the actuation volume 166 moves the diaphragm 162 against a diaphragm spring 170 located in the unsealed volume 168. The diaphragm spring 170 assists the exhaust valve spring 148 and assures that the diaphragm 162 and the corresponding actuation linkage 154 are brought to a correct resting position when the engine 22 is not running thereby preventing the invasion of water.

A portion of the pressure within the cylinder bores 68, as a result of the piston 72 compressing the air/fuel mixture, is channeled through the activation port 172 and restriction orifice 174 into a pressure condenser 176. The pressure is further channeled from the pressure condenser 176 through a pressure conduit 178 to the diaphragm chamber 164 where it is used to actuate the diaphragm while the engine is running.

With reference to FIG. 4, a valve head 180 is illustrated in a closed position shutting the exhaust passage 158 and preventing the invasion of water into the engine 22. An open position of the valve head 180 and the valve linkage 152 are shown in phantom and identified with the numerals 182 and 184 respectively. The valve head 180 moves to the open position 182 when while the engine 22 is running, allowing exhaust gases to enter the surrounding atmosphere.

Figure 6:
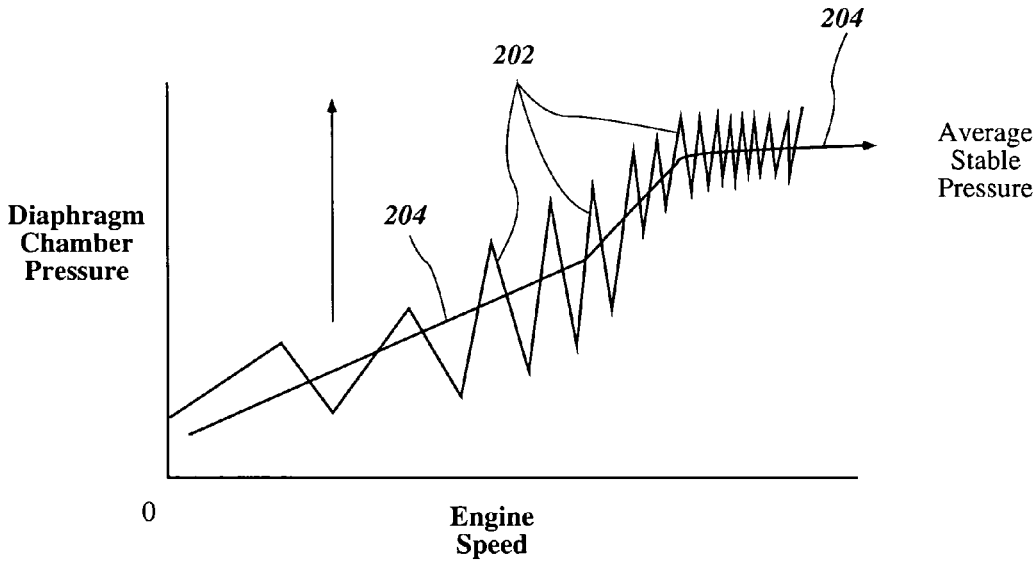
FIG. 6 is a graph illustrating the variation of cylinder and exhaust orifice pressure and engine speed.

FIG. 6 illustrates activation port pressure variations 202 which result from varying cylinder pressures. The variations 202 are smoothed by the condenser 176, resulting in a smoothed pressure represented by line 204. Therefore, a more uniform pressure is applied to the diaphragm thereby providing more reliable operation. This resulting pressure maintains the exhaust valve 146 in an open position while the engine 22 is running.

The pressure variations 202 are more prevalent at lower engine speeds where cylinder pressures are lower. The variations 202 increase in frequency as cylinder pressure and engine speed increase. Advantageously, the pressure condenser 176 provides a smoother pressure to activate the diaphragm 162, preventing excessive pressure pulses. Through a more uniform pressure, the diaphragm 162 can operate the exhaust valve 146 to properly expel exhaust gases into the atmosphere while the engine 22 is running without producing excessive back pressure.

Figure 7:
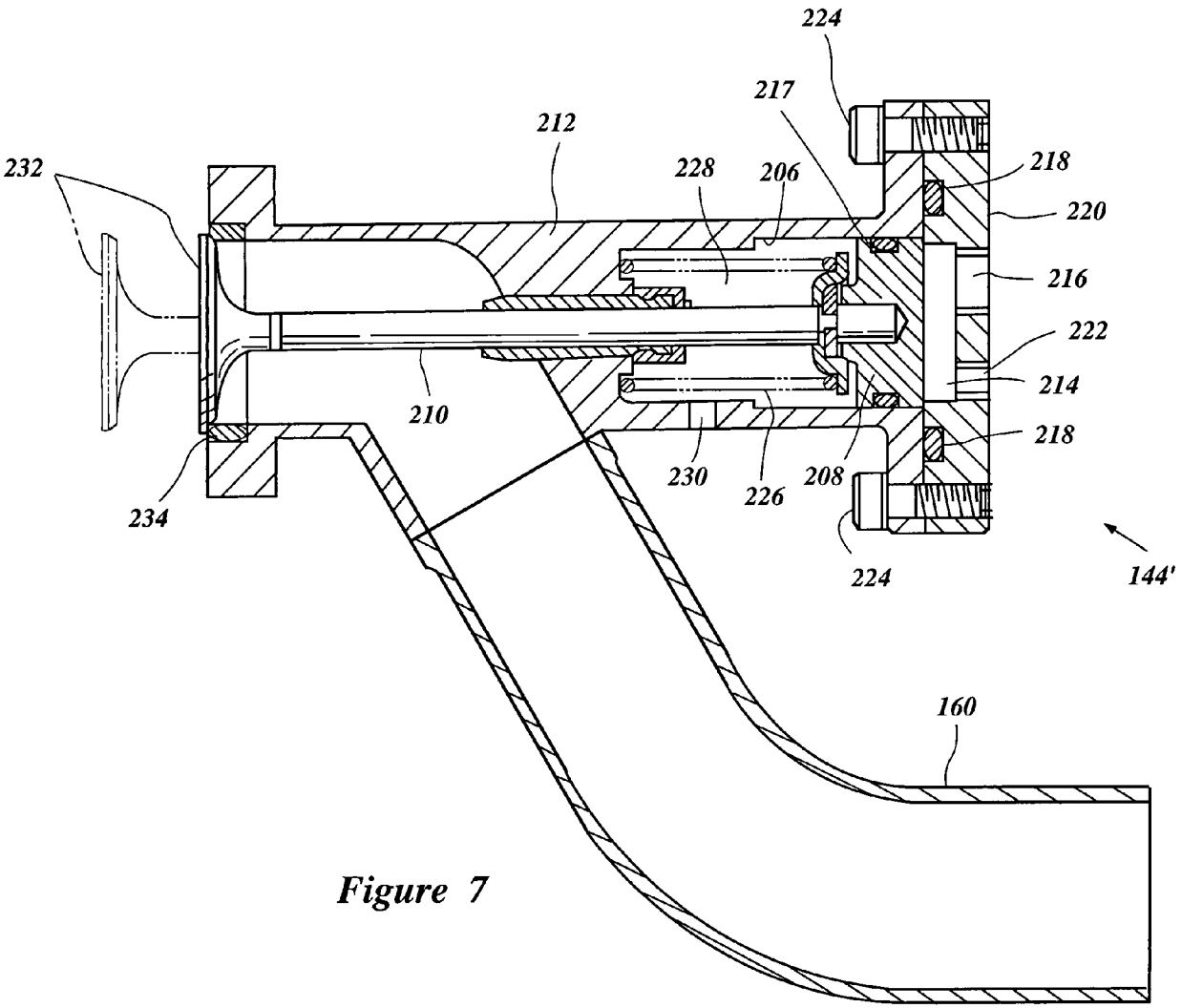
FIG. 7 is an enlarged partial sectional view of a modification of the water preclusion device illustrated in FIG. 4.

FIG. 7 shows a modification of the water preclusion device 144 illustrated in FIGS. 1–5, identified generally by the reference numeral 144'. The water preclusion device 144' comprises a cylinder 206 which contains a piston 208 within an exhaust valve housing 212. The piston 208 is connected to an exhaust valve 210. A piston seal 217 and a chamber cover seal 218 provide for a properly sealed expansion chamber 214 between the piston 208 and a chamber cover 220. An orifice 222 within the chamber cover 220 is sized to provide the expansion chamber 214 with a predetermined actuation pressure within the expansion chamber 214. Various bolts 224 fasten the chamber cover 220 to the exhaust valve housing 212.

The cylinder 206 and the piston 208 located within the exhaust valve housing 212 are configured to activate the exhaust valve 210. The pressure used to activate the diaphragm 162 in the first embodiment is used in the same manner to activate the piston 208 in the second embodiment as explained below.

The pressure conduit 178 delivers the actuation pressure to an expansion chamber 214 through an orifice 216. The actuation pressure within the expansion chamber 214 forces the piston 208 in a direction which opens the exhaust valve 210, allowing exhaust gases to flow from the engine 22 into the surrounding atmosphere. In this embodiment, the exhaust valve moves in a direction against the flow of exhaust gasses in order to open.

When under pressure, the exhaust gas within the expansion chamber 214 moves the piston 208 against an exhaust valve spring 226 located in a spring chamber 228. The spring chamber 228 incorporates a passage 230 to allow the spring chamber 228 to remain at atmospheric pressure. The exhaust valve spring 226 is configured to bias the piston 208 toward a resting position in which an exhaust valve head portion 232 is properly seated against an exhaust valve seat 234 when the engine 22 is not running, thereby preventing the invasion of water into the engine 22.

Of course, the foregoing description is that of certain features, aspects and advantages of the present invention to which various changes and modifications may be made without departing from the spirit and scope of the present invention. A watercraft need not feature all objects of the present invention to use certain features, aspects and advantages of the present invention. The present invention, therefore, should only be defined by the appended claims.

What is claimed is:

1. A watercraft comprising a hull, an engine supported by the hull, the engine including an engine body defining at least one combustion chamber, and an exhaust system comprising an exhaust gas passage extending from the engine body to a valve, the valve being configured to be controlled by pressure in a cylinder port passage, the cylinder port passage configured to communicate cylinder pressure from the engine body to the valve, the valve mounted at least partially in the exhaust gas passage and configured to be movable between a first position in which the exhaust gas passage is open and a second position in which the exhaust gas passage is closed and all fluid communication between the combustion chamber and the atmosphere through any portion of the exhaust gas passage is stopped.

2. The watercraft according to claim 1, wherein the exhaust system includes an atmospheric exhaust gas discharge positioned on the hull so as to be submerged when the watercraft is at rest on a body of water.

3. The watercraft according to claim 1, wherein the engine comprises a cylinder bore, a cylinder head mounted to one end of the cylinder bore, an exhaust port communicating with the exhaust system, a cylinder port communicating with the valve, the cylinder port mounted closer to the cylinder head than the exhaust port.

4. The watercraft according to claim 1 additionally comprising a pressure chamber and a movable diaphragm disposed in the pressure chamber, the diaphragm being connected to the valve such that movement of the diaphragm causes the valve to move.

5. A watercraft comprising a hull, an engine supported by the hull, the engine including an engine body defining at least one combustion chamber, and an exhaust system comprising an exhaust gas passage extending from the engine body to a valve, the valve being configured to be controlled by pressure in a cylinder port passage, the cylinder port passage configured to communicate cylinder pressure from the engine body to the valve, the valve mounted at least partially in the exhaust gas passage and configured to be movable between a first position in which the exhaust gas passage is open and a second position in which the exhaust gas passage is closed and all fluid communication between the combustion chamber and the atmosphere through the exhaust gas passage is stopped, wherein the valve is mounted to move such that positive pressure in the cylinder port passage up stream from the valve imparts a force onto the valve to move the valve in a direction towards exhaust gas flow.

6. The watercraft according to claim 5, wherein the exhaust gas passage comprises a valve seat extending around in inner periphery of the exhaust gas passage, the valve being configured to seal against the valve seat when the valve moves in a direction generally parallel to the flow of exhaust gas through the exhaust gas passage.

7. The watercraft according to claim 1, wherein the cylinder port passage includes an accumulation chamber disposed between the cylinder port and the valve.

8. They watercraft according to claim 1, wherein no portion of the exhaust gas passage is higher than uppermost portion of the engine body when the watercraft is at rest on a body of water.

9. A method of preventing water from flowing upstream in an exhaust system for a watercraft having an engine including an engine body defining at least one combustion chamber, a first exhaust conduit extending from the engine body to the atmosphere, and a valve mounted at least partially in the first exhaust conduit and configured to be movable between a closed position where all fluid communication between the combustion chamber and the atmosphere through any portion of the first exhaust conduit stops and an open position, the method comprising guiding pressure from the combustion chamber to a valve controller through a second conduit, moving the valve to the open position with pressure in the second conduit.

10. The method according to claim 9, wherein moving the valve comprises moving the valve in a direction opposite to the down stream flow of exhaust gases through the first exhaust conduit.

11. A watercraft comprising a hull defining an engine compartment, an engine positioned within the engine compartment, the engine comprising at least one cylinder including at least one cylinder port, a combustion chamber, and an exhaust system comprising a first exhaust conduit extending from the cylinder port to the atmosphere, the first exhaust conduit including at least one exhaust valve configured to prevent the invasion of water into the engine, the cylinder port being in communication with the exhaust valve, the exhaust valve being configured to move between a closed position where all fluid communication between the cylinder port and the atmosphere through any portion of the exhaust system stops and an open position, a pressure conduit communicating with the cylinder port for operating the exhaust valve while the engine is running.

12. A watercraft comprising a hull defining an engine compartment, an engine positioned within the engine compartment, the engine comprising at least one cylinder including at least one cylinder port, a combustion chamber, and an exhaust system including at least one exhaust valve configured to prevent the invasion of water into the engine, the cylinder port being in communication with the exhaust valve, the exhaust valve being configured to move between a closed position where all fluid communication between the combustion chamber and the atmosphere through the exhaust system stops and an open position, a pressure conduit communicating with the cylinder port for operating the exhaust valve while the engine is running, wherein the exhaust valve is activated by a linkage.

13. The watercraft as set forth in claim 12, wherein the linkage operated by a diaphragm.

14. A watercraft comprising a hull defining an engine compartment, an engine positioned within the engine compartment, the engine comprising at least one cylinder including at least one cylinder port, a combustion chamber, and an exhaust system including at least one exhaust valve configured to prevent the invasion of water into the engine, the cylinder port being in communication with the exhaust valve, the exhaust valve being configured to move between a closed position where all fluid communication between the combustion chamber and the atmosphere through the exhaust system stops and an open position, a pressure conduit communicating with the cylinder port for operating the exhaust valve while the engine is running, wherein the exhaust valve is activated directly by an exhaust valve piston.

15. The watercraft as set forth in claim 14, wherein the exhaust valve is returned to resting position by a spring.

16. A watercraft comprising a hull defining an engine compartment, an engine positioned within the engine compartment, the engine comprising at least one cylinder including at least one cylinder port, an exhaust system including at least one exhaust valve configured to prevent the invasion of water into the engine, the cylinder port being in communication with the exhaust valve, a pressure conduit communicating with the cylinder port operating the exhaust valve while the engine is running, the pressure conduit incorporating an expansion chamber, the expansion chamber being configured to smooth pressure fluctuations in the pressure conduit.

17. The watercraft as set forth in claim 16, wherein the pressure conduit incorporates a restriction orifice.

18. The watercraft as set forth in claim 16, wherein the exhaust valve is activated by a linkage.

19. The watercraft as set forth in claim 18, wherein the linkage is operated by an activation diaphragm.

* * * * *

UNITED STATES PATENT AND TRADEMARK OFFICE

CERTIFICATE OF CORRECTION

PATENT NO. : 7,029,347 B2
APPLICATION NO. : 10/270927
DATED : April 18, 2006
INVENTOR(S) : Hidenori Atsusawa It is certified that error appears in the above-identified patent and that said Letters Patent is hereby corrected as shown below:

In Column 2, Line 29, after “being”, please insert --in--

In Column 6, Line 44, please delete “96” and insert --196--

In Column 6, Line 46, please delete “Therfore” and insert --Therefor--

Signed and Sealed this

Thirteenth Day of February, 2007

JON W. DUDAS
*Director of the United States Patent and Trademark Office*